United States Patent [19]

Ozawa et al.

[11] Patent Number: 4,775,253

[45] Date of Patent: Oct. 4, 1988

[54] PRINTER WITH A MOVABLE CARRIAGE AND A LIGHT SOURCE MOUNTED OFF THE CARRIAGE FOR POSITIONING A TYPE ELEMENT MOUNTED ON THE CARRIAGE

[75] Inventors: Toshiaki Ozawa, Tokyo; Yasuaki Yamada, Funabashi; Hiroatsu Kondo, Zushi, all of Japan

[73] Assignee: Canon Kabushiki Kaisha, Tokyo, Japan

[21] Appl. No.: 11,397

[22] Filed: Feb. 4, 1987

Related U.S. Application Data

[63] Continuation of Ser. No. 786,729, Oct. 15, 1985, abandoned, which is a continuation of Ser. No. 579,002, Feb. 14, 1984, abandoned, which is a continuation of Ser. No. 308,510, Oct. 2, 1981, abandoned, which is a continuation of Ser. No. 53,778, Jul. 2, 1979, abandoned.

[30] Foreign Application Priority Data

| | | | |
|---|---|---|---|
| Jul. 4, 1978 | [JP] | Japan | 53-80533 |
| Jul. 4, 1978 | [JP] | Japan | 53-80534 |
| Jul. 4, 1978 | [JP] | Japan | 53-80535 |
| Jul. 4, 1978 | [JP] | Japan | 53-80536 |
| Jul. 4, 1978 | [JP] | Japan | 53-80537 |
| Jul. 4, 1978 | [JP] | Japan | 53-80538 |
| Jul. 4, 1978 | [JP] | Japan | 53-80539 |
| Jul. 4, 1978 | [JP] | Japan | 53-80540 |
| Jul. 4, 1978 | [JP] | Japan | 53-80541 |

[51] Int. Cl.[4] ..... B41J 1/30; B41J 25/30

[52] U.S. Cl. ..... 400/144.2; 400/320; 400/154.4; 400/705.1; 400/711

[58] Field of Search ..... 400/144.2, 705.1, 711, 400/154.4, 320, 162.3; 250/231 SE, 237 G

[56] References Cited

U.S. PATENT DOCUMENTS

| | | | |
|---|---|---|---|
| 3,502,414 | 3/1970 | Kreckel et al. | 356/152 |
| 3,611,412 | 10/1971 | Gibby | 400/146 X |
| 3,628,453 | 12/1971 | Jackson et al. | 101/93.13 X |
| 3,805,698 | 4/1974 | Bowers et al. | 101/93.14 X |
| 3,968,745 | 7/1976 | Hamisch | 101/288 X |
| 4,075,945 | 2/1978 | Bienholz | 400/146 X |
| 4,079,251 | 3/1978 | Osann | 250/237 G X |
| 4,118,129 | 10/1978 | Grundherr | 400/144.2 |
| 4,153,378 | 5/1979 | Scherrer | 400/200 X |
| 4,158,507 | 6/1979 | Himmel | 250/237 G X |
| 4,196,666 | 4/1980 | Kobayashi et al. | 400/146 X |

FOREIGN PATENT DOCUMENTS

| | | | |
|---|---|---|---|
| 1191086 | 5/1970 | United Kingdom | 400/705.1 |

*Primary Examiner*—Paul T. Sewell

*Attorney, Agent, or Firm*—Fitzpatrick, Cella, Harper & Scinto

[57] ABSTRACT

Impact type printer of a construction having a carriage including a character type wheel, a light source disposed outside the carriage, device for introducing light beam from the light source into the carriage such as a flexible photoconductor, a mirror, etc., and a detector to detect rotation of the character type wheel by application of the light beam introduced by the light beam introducing device to an encoder.

8 Claims, 10 Drawing Sheets

PRINTER WITH A MOVABLE CARRIAGE AND A LIGHT SOURCE MOUNTED OFF THE CARRIAGE FOR POSITIONING A TYPE ELEMENT MOUNTED ON THE CARRIAGE

This application is a continuation of application Ser. No. 786,729, filed Oct. 15, 1985, now abandoned, which in turn is a continuation of Ser. No. 579,002, filed Feb. 14, 1984, now abandoned, which in turn is a continuation of Ser. No. 308,510, filed Oct. 2, 1981, now abandoned, which in turn is a continuation of Ser. No. 053,778, filed July 2, 1979, now abandoned.

BACKGROUND OF THE INVENTION

1. Field of the Invention

This invention relates to an impact type printer.

2. Description of the Prior Arts

Recently, there have been introduced the digital technique and the servo-control technique into the field of character printing control. As the result of this, for example, speed and position controls of a motor to drive a character type wheel having a various character type faces are widely performed by detecting its rotational position. In order to carry out such speed and position controls of the motor with high precision, it is necessary that a circular disc provided on the motor be provided with as many radial slits as possible around its circumference. Also, in recent years, the printing apparatus tends to be miniaturized by the use of a photo-encoder. As the result of this, there is used a small-sized disc having a multitude of radial slits in it. In case such a disc is used, a space interval between the slit disc and a detector largely governs the characteristic of the photo-encoder. Also, one of the important factors to determine the number of the slits to be formed resides in the light source for the photo-encoder. Therefore, unless the light source capable of generating parallel light beams of high intensity is used, the intended size-reduction in the slit disc and increase in the number of the slits therein are impossible. With a view to attaining this purpose, there has so far been used a light source having a high intensity such as, for example, an incandescent lamp, an infrared ray lamp, LED, and so forth, with which parallel light beams are produced by an optical system using a lens, etc. Accordingly, such light source device is inevitably large in size in comparison with the slit disc and surrounding apparatuses therefor. In particular, when the photo-encoder is incorporated in a carriage, there accrues such disadvantage that not only the driving source, such as a motor to drive the carriage, becomes large, but also the apparatus per se, incorporated with the carriage, becomes inevitably large in size.

On the other hand, there have been developed various kinds of type wheels to be provided in the printer, in which each of the types is fixedly provided at the tip end parts of each a group of of radial spokes. Of these type wheels, the one in which the types are integrally formed with wheel made of a plastic material, or the one in which the types made of a plastic material are incorporated in the spokes of different material are advantageous in that they are cheap in the manufacturing cost, while they have such a serious disadvantage that their service life is short. The reason for such disadvantage is that those types bearing symbols, e.g., "_", ",", ".", "~", etc., which are usually located off the center of the striking hammer, are liable to hit the platen askew at the time of printing to cause the edge of the type to wear, or that, in the case of the type with metal plating applied on the plastic base, they bring about exfoliation of such metal-plated layer, as the result of which the entire type wheel becomes necessary to be replaced due to damage caused to only one part of the type bearing such symbol.

Also, a flying type impact printer, which is operated by rotating a type wheel provided with matrix types at a high speed, energizing a printing hammer in synchronism with positioning of a selected type on the wheel, when it arrives at a predetermined position, to impart striking force to the chareacter type, thereby performing the printing, has such a disadvantage that it causes digression of the type from its right printing position, because the printing is performed in the state of the type wheel being in rotation.

Further, another impact type printer, which is operated by rotating the type wheel or an endless type belt, on which a plurality of types are held through resilient supporting piece, to select a printing position of the type to be printed, and performing the character printing by striking the type by a printing hammer to the platen over the top surface of an ink ribbon and printing paper, also has such a diadvantage that considerable noise occurs, due to impact at the time of the printing.

Incidentally, the impact type printer can be broadly classified into a type drum printer and a type wheel priner. Various other kinds may also be contemplated, besides these kinds. The type wheel printer uses the type wheel having a plurality of types provided at the tip end parts of a plurality of radially extending spokes. This type wheel is controlled for its lateral movement in parallel with, and along, the axial line of the platen. When a type as selected from the type wheel arrives at a predetermined printing position, the rear surface of the type is struck by a printing hammer against resilient force of the spokes to thereby perform the character printing.

Usually, arrangement of the types on the type wheel is such that each and every type is arranged on one and the same diameter of the wheel with an equal area. However, the area to be occupied by each and every type differs from character to character, i.e., some occupy the whole area, while the others occupy only a small portion of the ara. For the type occupying the small portion of the area, there may be enumerated a point (.), a comma (,), an underline (_), and small letters of the alphabet.

Therefore, when the impact force of the printing hammer to each of the types on the type wheel is so adjusted as to be adapted to print the character of a large area portion such as, for example, capital letters of an alphabet, the impact force of the printing hammer to the types having smaller character area as mentioned above becomes excessive, since the impact force of the printing hammer concentrates on the small character area, as the result of which the printing force to the platen (i.e., the impact force per unit area of the type) becomes more excessive than in the case of the type having large character area. As the result of this, the printing density of the small type becomes higher than that of the large type, and the density as a whole becomes non-uniform and the resulted print appears poor in quantity. This is a common disadvantage in principle both for the abovementioned type wheel printer and the impact type printer of the other system.

Furthermore, there has been known a printer, in which a selected type is struck by a printing hammer at its position for printing to thereby effect printing. Such apparatus is provided with a device for selecting one type out of a train of types, but it has inevitably an extremely complicated mechanical construction.

There has also been known an impact type printer equipped with a type belt on a carriage movable in parallel with the platen, in which the type belt is rotated by a motor to select an desired type on the type belt at its printing position, and the thus selected type is then struck by a printing hammer to perform the printing operation. Such impact type printing apparatus is required to have such a construction that a type bearing member may be readily mounted or dismounted, or replaced, when it becomes necessary to do so. Another advantage with this type of the printer is that, in most cases, the hands and clothing of operates tend to become stained.

SUMMARY OF THE INVENTION

It is an object of the present invention to provide a photo-encoder which is small in size, has a stable characteristic, and maintains a constant space interval between the slit disc and the detector by urging the slit disc slightly toward the light receiving side of the detector so as to maintain a state in which the slit disc always contacts the light receiving side.

The device is characterized in that a light source is provided at a place other than the carrier, and light from the light source is introduced into the photo-encoder in the carrier through optical fiber, etc. with a view that the size of the light source may not give influence, as far as possible, on the size of the carriage incorporated therein with the photo-encoder, or an apparatus incorporated therein with such carriage.

It is another object of the present invention to avoid an uneconomical situation to take place such that the entire type wheel is wasted due to partial wear or damage of the type in the wheel as mentioned in the foregoing.

It is still another object of the present invention to carry out high quality character printing free from displacement and deviation of the type by effecting the hammering only after the selected type is perfectly brought to and stopped at the printing position. This can be attained by providing a clutch device between the type wheel and a motor to drive the same, disconnecting the clutch device at the time of energizing the printing hammer to interrupt transmission of the driving force from the motor to the type wheel, and, at the same time, mechanically stop its rotation, and, thereafter, giving impact force to the type by the printing hammer to thereby effect the printing.

It is a further object of the present invention to decrease, in the impact type printer, the amount of noise that occurs at the time of striking the type, which is the short-coming in this type of the printer.

It is still further object of the present invention to remove non-uniformity in the printing density in the impact type printer and to increase the quality of the resulting print. This object can be achieved by appropriate selection of a resistance force in each character type against the impact force of the printing hammer so that, irrespective of the surface area of the type, the impact force to the platen of the type may be substantially uniform.

It is a further object of the present invention to reduce the size in the surrounding devices of the printer such as a type belt ring, a cassette for the type belt ring, and so on. For the size-reduction in the type belt, it may be provided with a train of the types in a plurality of rows such as upper and lower rows in the belt.

It is another object of the present invention to construct in a simple way the device for selecting any one of the types from the plurality of the character trains.

It is still another object of the present invention to permit ready removal the type belt cassette from the printer.

In order the attain the abovementioned objects, the present invention is so constructed that the type belt is accommodated in a cassette in a manner to extend therein through a drive pulley and guide rollers; an ink feeding roller is also provided in the cassette with its one part being press-contacted to the type belt; then the ink roller is drawn outside the side wall of the cassette by oscillating the bearing member of the ink roller against a press-contacting spring to loosen the press-contact force to the type belt so as to enable the belt to be mounted, dismounted, or replaced.

DETAILED DESCRIPTION OF PREFERRED EMBODIMENTS

Figure 1:
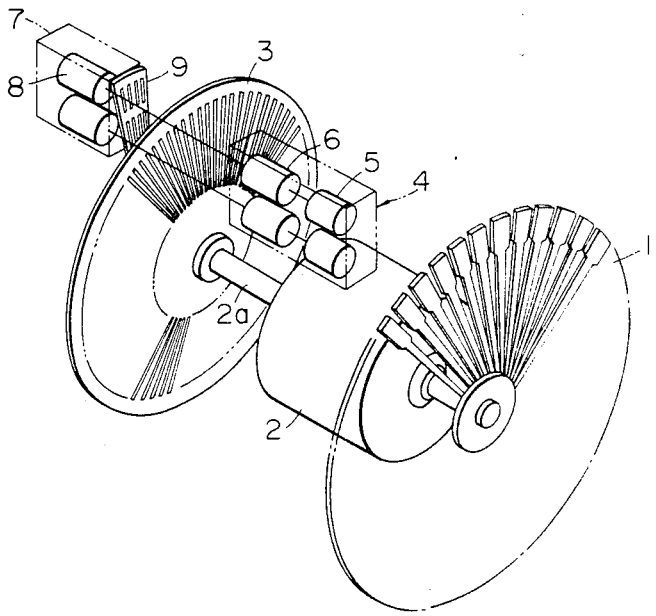
FIG. 1 is a perspective view showing a photo-encoder.

FIG. 1 shows one embodiment of the photo-encoder for controlling the type wheel. The type wheel 1 is fixedly mounted at one end of a shaft 2a for a motor 2. Also, a slit disc 3 is fixedly mounted at the other end of the shaft 2a for the motor 2. The slit disc 3 is made of an elastic material such as, for example, film, phosphor bronze, etc. A light emitting member 4 is disposed at an extremely close distance to the slit disc 3. Within the light emitting member 4, there are accommodated, for example, an appropriate light source 5 such as LED, and a lens 6 to convert the light from the light source 5 to a pseudo-parallel light beam. In confrontation to the light emitting member 4, there is disposed a light receiving member 7. The slit disc 3 is interposed between the light emitting member 4 and the light receiving member 7. The light receiving member 7 accommodates therein a light receiving element 8 such as, for example, a photo-transistor, etc. In order that the light receiving member 7 may obtain the light output from the light emitting member 4 through the slit disc 3 with substantially the same degree of the output as the pitch of the slit disc 3, an index slit 9 for light constriction is provided on the light receiving member 7. At one side of the light receiving member 7 facing the slit disc 3, there is provided, slightly projecting from the index slit 9, a slit disc positioning member 10 made of a material excellent in wear-resistance and being soft in texture that does not impair the opposite member which contacts it, such as polyurethance rubber, and the like.

Figure 2:
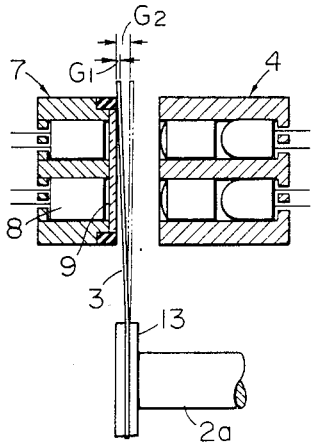
FIG. 2 is a side elevational view showing a positional relationship between the conventional slit disc and the detector.
Figure 3:
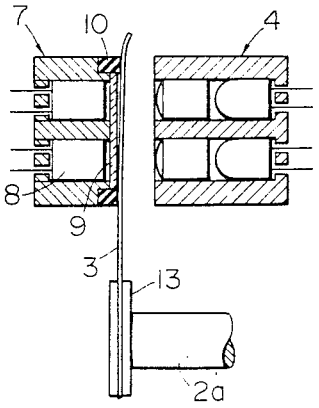
FIG. 3 is a side elevational view showing a positional relationship between the slit disc and the detector according to the present invention.
Figure 4:
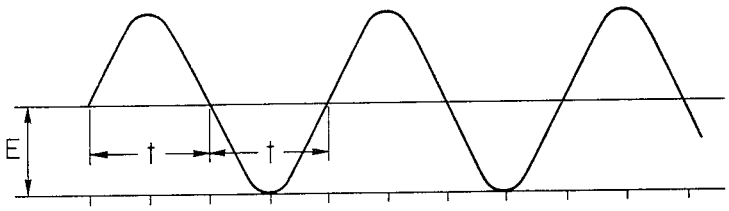
FIGS. 4 to 6 are respectively waveform diagrams of an output from the detector.
Figure 5:
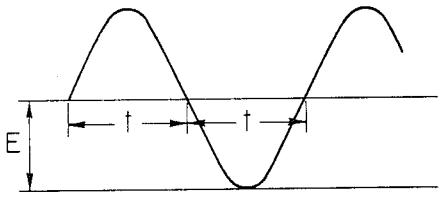
Figure 6:
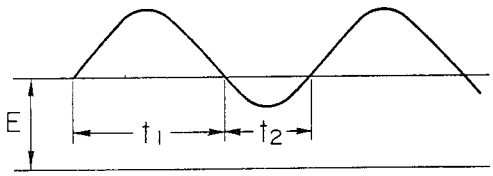

FIG. 2 show a positional relationship among the slit disc 3, the light emitting member 4 and the light receiving member 7. The slit disc 3 changes it space interval with the index slit 9 from its minimum value of G1 to its maximum vlue of G2 due to deflection of the motor shaft 2a, or deflection of the slit disc 3 per se and a fixing member 11 therefor. An output which is required for performing highly precise control should primarily have substantially the same time t between the high and low outputs than a detection level E, and a constant amplitude, as shown in FIG. 4. When the space interval between the slit disc 3 and the index slit 9 is the minimum value of G1, substantially the same output as in FIG. 4 can be obtained (vide FIG. 5). However, with the maximum value of G2, there takes place a considerable difference between a time $t_1$ for the output higher than the detection level E and a time $t_2$ for the output lower than the detection level E, while the amplitude becomes also small in case of the low output. As the result of this, the highly precise control is hindered.

The present invention is intended to solve these problems, the actual embodiment for which is shown in FIG. 2. As seen clearly in the drawing, the slit disc 3 made of an elastic material is slightly flexed and contacted to the slit disc positioning member 10. That is, the slit disc 3 rotates in a state, in which it is forced in a direction to be constantly urged to the index slit 9. And, even if there occurs a large deflection in the slit disc 3 as shown in FIG. 2, the disc 3, by its self-resiliency, contacts the index slit 9 to make it possible to maintain a constant space interval therebetween. Accordingly, the output from the light receiving member 7 is stabilized as shown in FIG. 4, whereby the high precision control becomes feasible.

Figure 7:
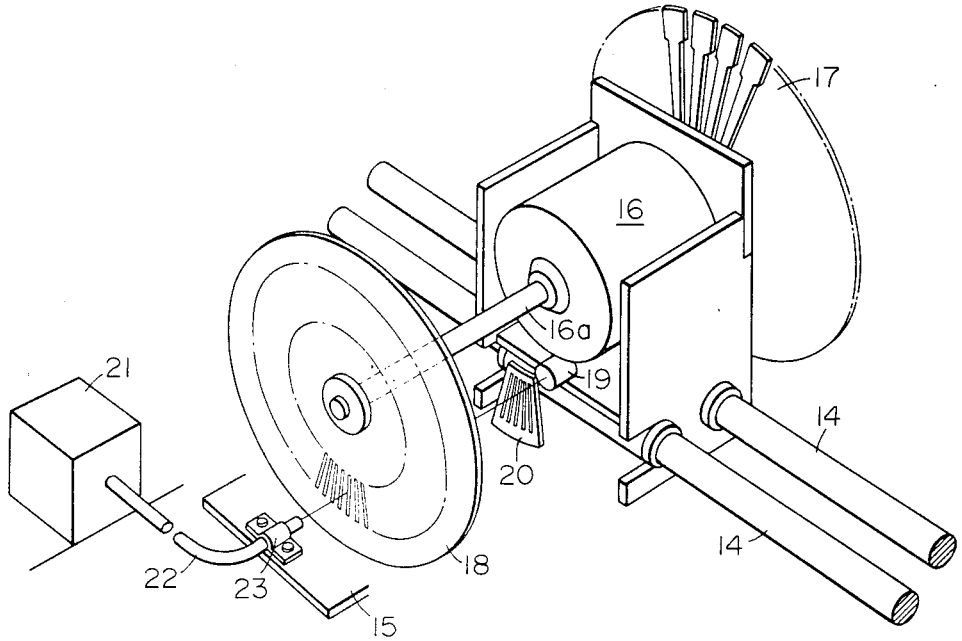
FIG. 7 is a perspective view showing one embodiment of the encoder according to the present invention.

In the following, explanations will be given in reference to FIG. 7 as to an actual embodiment of the photo-encoder for the printer, which does not increase the size of the printer carriage. As shown in the drawing, a motor 16 is mounted on a carriage 15 which moves along guide rods 14,14. A type wheel 17 and a slit disc 18 are fixedly mounted on both ends of a shaft 16a of the motor 16. An index slit 20 is fixed on the carriage 15. A light source 21 is disposed at the side of the printer main body externally of the carriage, and introduces light into the carriage 15 through an optical fiber 22. The extreme end of the optical fiber 22 is fixed to the carriage 15 by a fitting 23. The fiber is extensible and shrinkable between the light source and the carriage.

Since the present invention is constructed as mentioned above, the size of the carriage is not affected, even when the light source increases its size, hence the carriage as a whole can be made small in size and the motor to drive the carriage may be of a small capacity. In addition, there is a great advantage such that highly precise control can be effected by increasing the number of slits.

Figure 8:
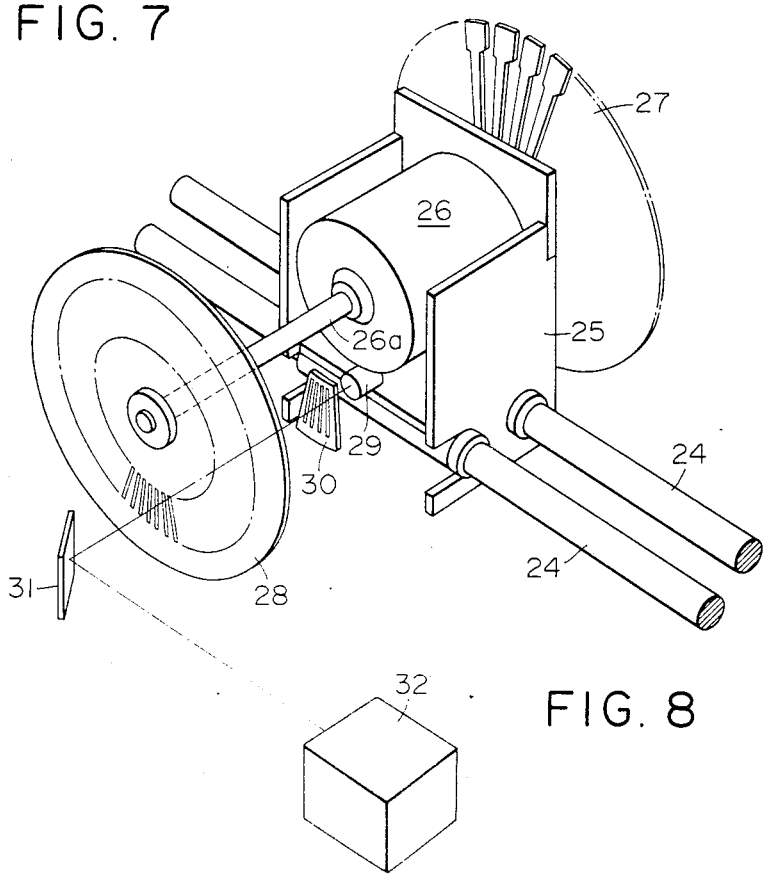
FIG. 8 is also a perspective view showing a part of a typewriter, in which the present invention is applied.

In the following, another embodiment of the present invention will be explained in reference to FIG. 8 which shows a typewriter incorporated with the photo-encoder a using laser as the light source.

A motor 26 is mounted on a carriage 25 which moves in parallel with a platen (not shown) along guide rods 24,24. A type wheel 27 and a slit disc 28 are fixedly mounted on both ends of a shaft 26a of the motor 26 as the discs to be controlled. A light receiving element 29, a slit index 30, and a mirror 31 for reflecting a laser beam in the direction of the light receiving element 29 necessary for performing the position and speed controls of the type wheel 27, are mounted on the carriage 25. A reference numeral 32 designates a laser device, the laser light beam of which is reflected by the mirror 31 and is projected into the light receiving element 29 through the index slit 30. FIG. 8 illustrates that the laser device 32 is disposed outside the carriage 25, although it may be mounted on the carriage, if the carriage needs not be reduced in size. In the latter instance, the mirror 31 is not required.

Since the apparatus according to the present invention does not require a large-sized light source and optical lens as has heretofore been the case, the printer as a whole can be made small in size, and, furthermore, by adoption of the laser beam, the number of slits around the disc can be increased for the improvement of the detection precision. Also, disposition of the laser device outside the carriage would be effective in reducing weight and size of the carriage.

Figure 9:
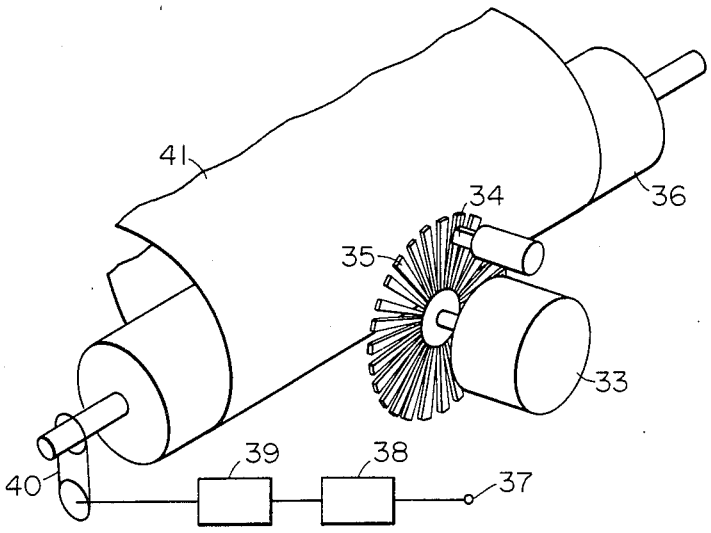
FIG. 9 is a perspective view showing a main part of a printer, to which the present invention is applied.

Still another embodiment of the present invention will be explained hereinbelow in reference to FIG. 9. In the drawing, reference numerals 33, 34, and 35 respectively designate a motor, a hammer, and a type wheel fixedly mounted on one end of a shaft of the motor 33 and having types at the tip ends of a multitude of radial spokes. The motor, hammer and character wheel are mounted and held on a carriage (not shown). The carriage moves in parallel with, and along, the axial line of a platen 36, selets a character to be printed out of the type wheel 35 by the motor 33, and effects printing by the hammer 34.

Figure 10:
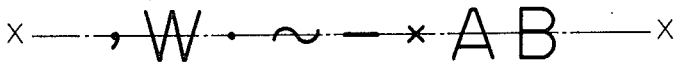
FIG. 10 is an explanatory diagram of an arrangement of the types according to the present invention.

In the present invention, all letters and symbols are so disposed that their center is exactly on the axial line X—X for printing, as shown in FIG. 10. When it becomes necessary to print a character at a position off the axial line X—X, either upper or lower, a printing paper 41 is displaced upwardly or downwardly by manipulating a button 37 which is installed on, for example, a carriage gripping handle, driving a pulse motor or a servo-motor 39 by an electrical control circuit 38, and rotating the platen 36 through a power transmission mechanism 40, after which the type is struck by the hammer 34.

Figure 11:
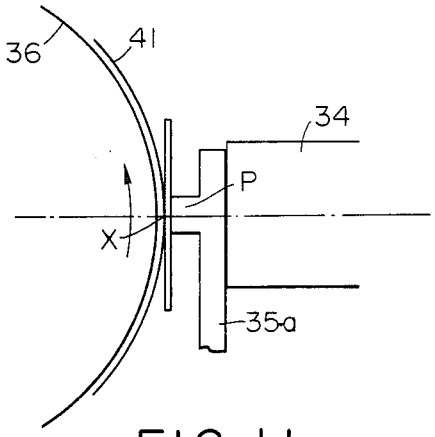
FIG. 11 is a diagram for explaining a state of character printing when the types in the FIG. 10 arrangement are used.

Since the apparatus is constructed as such, the upper and lower center of the type face P can be maintained on the axial line X—X for print, as shown in FIG. 11, to always maintain alignment with the center for the hammering of the hammer 34. As the result of this, askewed application of the type is avoided to prevent the type from partial wear, and clear and high quality of the print can be attained over a long period of time. Prolonged use of the type wheel as the whole has an effect of remarkably reducing its maintenance cost.

Figure 12:
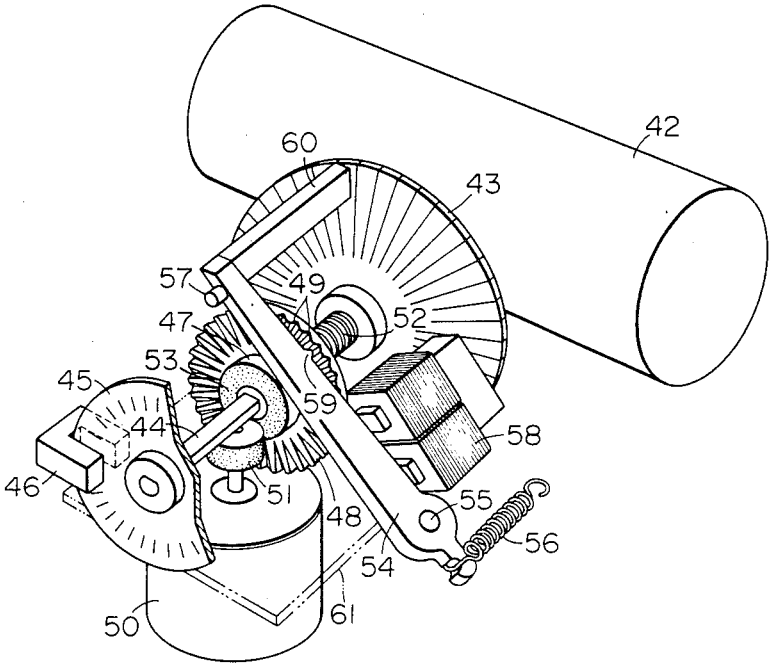
FIG. 12 is an enlarged perspective view of the main part of the printer according to the present invention.
Figure 13:
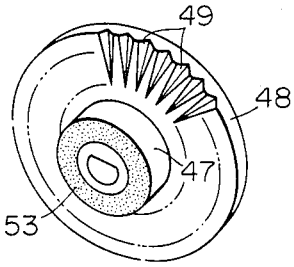
FIG. 13 is an enlarged perspective view of a part of a clutch disc.

A further embodiment of the printer according to the present invention will be explained hereinbelow in reference to FIGS. 12 and 13. Reference numerals 42 and 43 respectively designate a platen, and a type wheel with types provided at the tip ends of a multitude of radial spokes. The type wheel 43 is fixedly mounted on a shaft 44 having a D-shaped cross-section (a bearing therefor being not shown). A numeral 45 refers to a slit disc which is fixedly mounted on the opposite end of the shaft 44 to the type wheel. The slit disc 45 performs the position detection of each type on the type wheel in cooperation with a detector 46. A numeral 47 refers to a clutch disc which is fitted on the shaft 44 in a freely slidable manner. A numeral 48 is a disc integrally formed with the clutch disc 47, the outer periphery of which has a plurality of engagement grooves formed at positions corresponding to the positions of the types on the type wheel. A reference numeral 50 designates a motor, and 51 refers to a friction wheel (clutch disc) fixedly provided on the motor shaft. The clutch disc 47 on the shaft 44 and the brake disc 48 integral with it are constantly urged toward the friction wheel 51 of the motor 50 by means of are urging spring 52, whereby the friction surface 53 of the clutch disc 47 contacts the friction wheel 51 to be maintained in a clutch-on state. Accordingly, when the motor 50 rotates, its rotation is transmitted to the shaft 44 through the friction wheel 51 and the clutch disc 47, whereby the type wheel 43 and the slit disc 45 start rotation. A numeral 54 refers to an armature which is held in a freely oscillatable manner with a shaft 55 as its center of oscillation. It is usually biassed in the counter-clockwise direction by a coil spring 56, and received by a stopper 57 to be brought into a stopped state. It rotates in the clockwise direction against the spring 56 as soon as the electric current flows in on electromagnetic coil 58. By the clockwise rotation of the armature 54, the clutch disc 53 on the shaft 44 and the brake disc 48 integral therewith are urged in the direction away from the clutch disc on the motor shaft along the shaft 44 against the spring 52, whereby the clutch is disconnected. Also, by the engagement of an engaging section 49 of the disc 48 and an engaging member (projection) 59 provided on the armature 54, the inertial rotation of the shaft 44, i.e., the type wheel, is hindered. A numeral 60 refers to a print hammer interposed between the tip end of the armature 54 and the type wheel 43 with the same being held by a slide guide member (not shown). The print hammer 60 is constantly biassed in the direction of the armature 54 by means of a return spring (not shown), and held in a state of the rear end surface of the hammer being urged to the armature 54. The above-mentioned member 43 to 60 are mounted and held on the carriage 61, and controlled for its lateral movement in parallel with, and along, the shaft of the platen 42. (In the drawing, the carriage moving mechanism is omitted.)

When a selected type on the type wheel 43 has arrived at a predetermined printing position by the movement of the carriage 61 and the rotation of the motor 50, the position of the type is detected by the slit disc 45 and the detector 46, by the detected signal of which current flows through the electromagnetic coil 58, and the armature 54 is attracted to the electromagnet to effect the clockwise turn with the shaft 55 as the center of its oscillation. By this rotation of the armature 54, the projection 59 of the armature is engaged with the notched groove 49 of the disc 48 as already mentioned. Also, the disc 48 and the clutch disc 47 integral therewith are moved in the direction of the platen along the shaft 44 against the spring 52, whereby the disc 48 is separated from the friction wheel 51 and the rotation of the motor 50 is no longer transmitted to the shaft 44. Further, by the engagement of the engaging member 59 and the notched groove 49 of the disc 48, rotation of the shaft 44 is mechanically stopped instantaneously, i.e., the type wheel 43 completely stops. At this instance, the relative positions among the type wheel 43, the engaging groove 49 of the brake disc 48, and the engaging member 47 of the armature 54 are so designed beforehand that the selected character type on the type wheel 43 may be accurately stopped at the predetermined position for the printing. Thereafter, the printing hammer 60 is pushed in the direction of the character wheel 43 by the rotational force of the armature 54, and the tip end face thereof hits the back surface of the stationary selected type, whereby the character printing is carried out.

Since, as mentioned, the printer according to the present invention is of such construction that the character type is hit by the printing hammer when the selected type is brought to a perfectly stopped state at a predetermined printing position, there is no possibility of displacement and deviation of the printed letter and of the character type due to rotational inertia of the type wheel. Accordingly, the high speed operation of this type of the printer is not impaired and high quality printing can always be attained.

Figure 14:
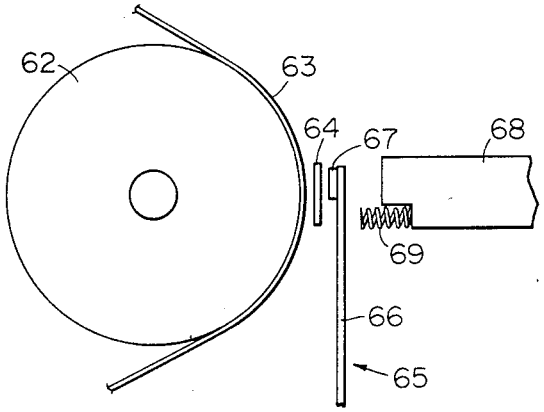
FIG. 14 shows a state of the printer prior to its character printing.

Another embodiment of the printer according to the present invention will be described in reference to FIG. 14 illustrating an impact type printer using the type wheel. In the drawing, 62 refers to a platen, 63 a printing paper, 64 an ink ribbon, 65 a type wheel consisting of a multitude of radially extending resilient spokes 66 and types 67 formed on the tip ends of the spokes at the side facing the platen, and 65 a printing hammer.

The type wheel 65, a drive mechanism therefor, the printing hammer 68, and a drive mechanism therefor are mounted on the common carriage and controlled for their lateral movement in parallel with the platen 62. The drive mechanisms for the type wheel and the printing hammer and the carriage mechanism are same as those in conventional printer, hence their illustration has been dispensed with. When a selected type 67 on the type wheel for printing is brought to the printing position over the printing paper by rotation of the type wheel and movement of the carriage, the printing hammer 68 projects toward the platen 62 in synchronism with positioning of the type, strikes the rear surface of the type to cause the type to hit the platen 62 over the ink ribbon 64 and the printing paper 63, thereby performing the character printing. At this time, vibrating sounds of the type and the printing paper make the printing noises.

The printer as mentioned above is characterized by a member to energize a type in the direction of the platen in advance of the printing operation against elasticity of the supporting member therefor so that undesirable noises at the printing operation in the impact type printer may be reduced.

Figure 15:
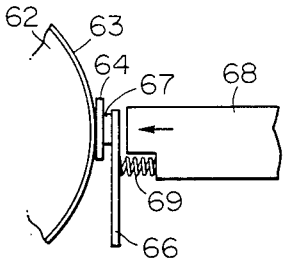
FIG. 15 shows a state of the printer immediately before the printing hammer strikes the back surface of the type.
Figure 16:
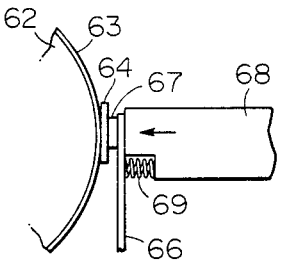
FIG. 16 shows a state of the printer, in which the printing hammer has just struck the type.
Figure 17:
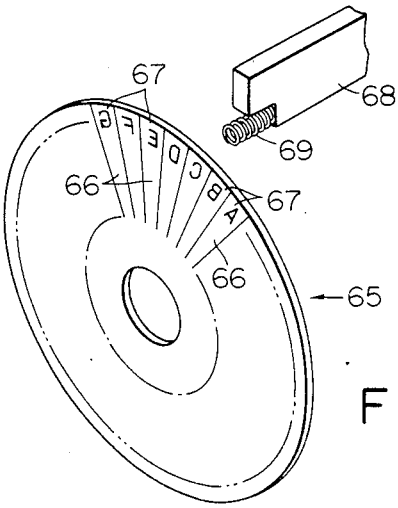
FIG. 17 is an enlarged perspective view showing a part of the printing hammer and the character wheel.

The drawing illustrates such energizing member (coil spring, elastic rubber, etc.) which is projected slightly beyond the tip end face of the printing hammer 68. In more detail, when the printing hammer 68 projects towards the platen, the tip end of the elastic member 69 which projects slightly from the end surface of the hammer 68 first strikes the rear surface of the type 67 to be printed, and the type is pushed forward toward the platen against elasticity of the spoke 66 and is urged to the platen 1 through the ink ribbon 64 and the printing paper 63. Next the resilient member 69 is compressed between the rear surface of the type and the printing hammer 68 by its subsequent forward movement (vide FIG. 15). During this period, the type is urged toward to the platen. Thereafter, while the type is being urged toward the platen by the projecting resilient member, the tip end of the hammer strikes the rear surface of the type, thereby performing the character printing.

As stated above, the printer according to the present invention is so constructed that, before the type 67 is struck by the printing hammer 68, the type is urged toward the platen against elasticity of the supporting member 66 and is kept in that urged condition, after which the type is struck by the printing hammer on its rear surface. Therefore, undesirable vibrations to the type at the time of its striking, and vibrations of the printing paper can be suppressed and the printing noises can be remarkably reduced.

The type energizing member may be provided on the carriage separate from the hammer 68 so that the type to be printed may be energized toward the platen against elasticity of the supporting member 66 thereof prior to printing by the hammer 68. In this case, the energizing member may be of a rigid body, instead of an elastic body.

The present invention can be suitably applied not only to the type wheel printer, but various other kinds of impact type printer performing the character printing by striking the resiliently held type by a printing hammer such as that using a type belt, on which a plurality of types are mounted through a resilient supporting member, and so forth.

Figure 18:
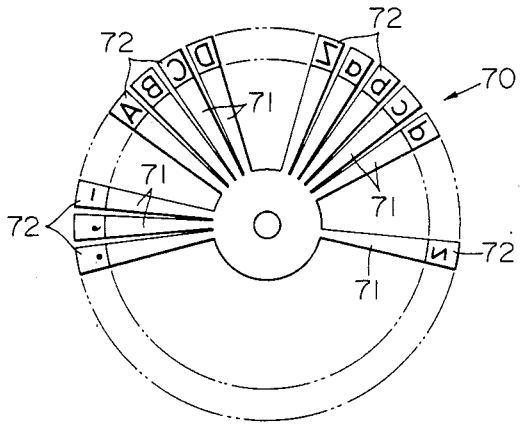
FIG. 18 is a front view of the type wheel.

A further embodiment of the printer according to the present invention will be explained hereinbelow in reference to FIG. 18.

In the illustrated embodiment of the type wheel, the spokes 71 to support the types having small character area such as small letters of the alphabet, and special symbols such as point (.), comma(,), underline (_), and so forth are made relatively thick in their gauge d in comparison with that of the spokes to support the types having large character area such as capital letters of the alphabet. By thus thickening the gause d of the spokes for the types of the small area, the types of the small character area reduce their stroke caused by flexure of the spoke with respect to a certain definite striking force F of the printing hammer 74 than in the case of the type having the large character area (i.e., the resistance against the striking force of the printing hammer becomes large) with the consequence that the impact force at the time of striking the platen is relaxed and the print density becomes low for this relaxed impact force. In other words, irrespective of the printing area, the printing pressure to the platen of each and every type becomes substantially uniform. As the result, the printing density as a whole becomes uniform, and the printing character is easy to read, hence the print quality increases.

Figure 20:
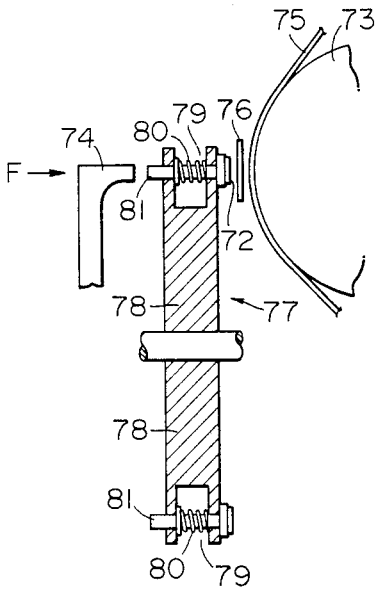
FIG. 20 is also a side elevational view of the main part of the other embodiment of the printer.

FIG. 20 shows another embodiment of the printer of a type, in which a groove 79 is formed at the tip end of each of the spokes 78 of the disc 77, a pin 81 integral with the rear surface of the type is inserted into each spoke passing through the front and rear walls of the groove, then the type 72 is constantly kept drawn toward the side of the spoke by means of a return spring 80, and a selected type on the type wheel is struck against elasticity of the return spring 80 by means of the printing hammer 74 at the rear end of the pin 81, whereby the type is pushed forward from the spoke to effect the character printing.

Figure 19:
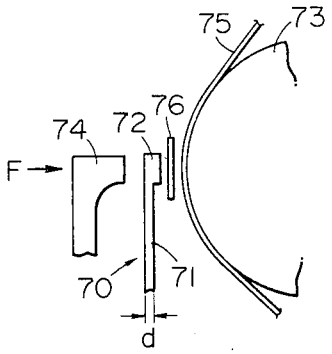
FIG. 19 is a side elevational view of the main part of the printer.

In this case, the spring constant of the return spring 80 for the type having small typing area is designed to be greater than that of the return spring for the type having large typing area. In this way, the type having small typing area reduces its projecting stroke against the return spring 80 with respect to a certain striking force F of the hammer 74 in comparison with the case of the type having large typing area with the result that impact force to the platen is relaxed as is the case with the embodiment shown in FIG. 19. As the result of this, the printing force to the platen by both types having large typing area and those having small typing area becomes substantially uniform, whereby any non-uniformity in the printing density due to difference in the typing area can be eliminated.

As mentioned above, the printer according to the present invention is capable of producing uniform printing density regardless of the typing area, as the result of which the printed character becomes easy to read and the print quality improves, and the aforementioned defects in the conventional impact type printer are removed. It should be noted that the present invention is applicable not only to the printer of the illustrated type, but also to the other kinds of the impact type printers.

Figure 21:
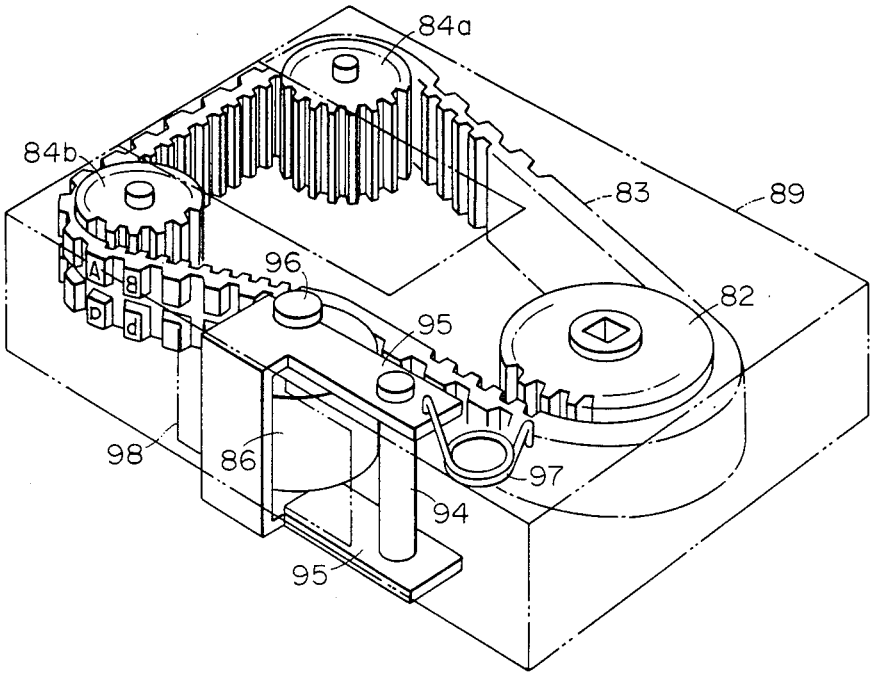
FIG. 21 is a perspective view of a type belt cassette.
Figure 22:
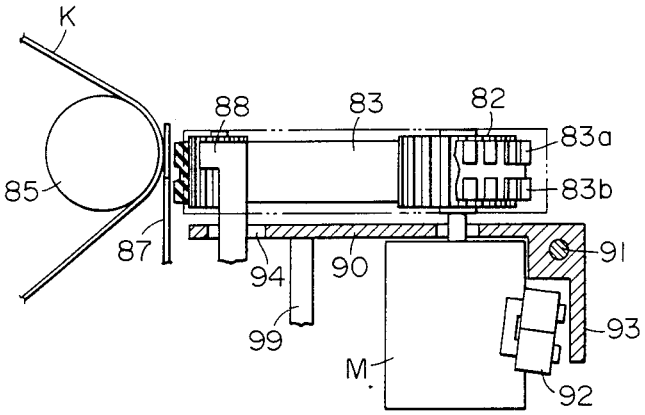
FIG. 22 is a side elevational view, in longitudinal cross-section, of the printer of the present invention, when it is printing with the upper type train.

Referring now to FIG. 21, another embodiment of the printer according to the present invention will be explained. The drawing shows a construction of a type belt cassette, in which a reference numeral 82 designates a pulley associaed with a motor M, 83 refers to a type belt driven by the pulley 82, **84*a*, 84*b* refer to guide rollers for the type belt, the rectilinear portion of the type belt between these rollers facing a platen 85 as shown in FIG. 22. These members 82, 84*a*, and 84*b* are accommodated in a cassette 89. A reference numeral 86 designates an ink feeding roller. Instead of such ink feeding roller, an ink feeding ribbon may be disposed between a printing paper K and the type belt 83. A numeral 87 refers to a contamination preventive plate, 88 refers to a printing hammer which imparts impact force at the center part between the guide rollers 84a, 84b to a selected type on the type belt 83. The printing hammer 88 is so constructed that it may move back and forth in the direction perpendicular to the platen 84** by an appropriate electromagnetic or mechanical means (not shown).

Figure 23:
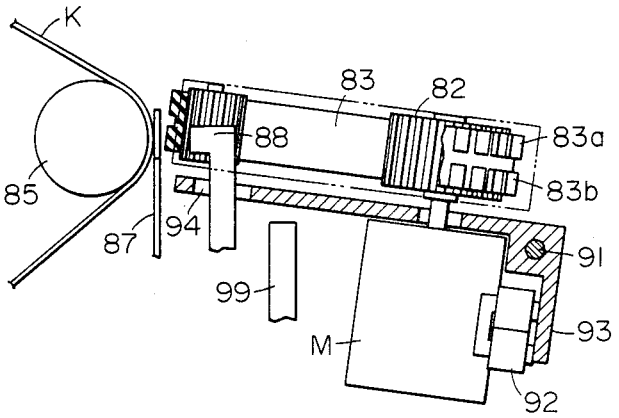
FIG. 23 is a side elevational view, in longitudinal cross-section, of the printer of the present invention, when it is printing with the lower type train.
Figure 24:
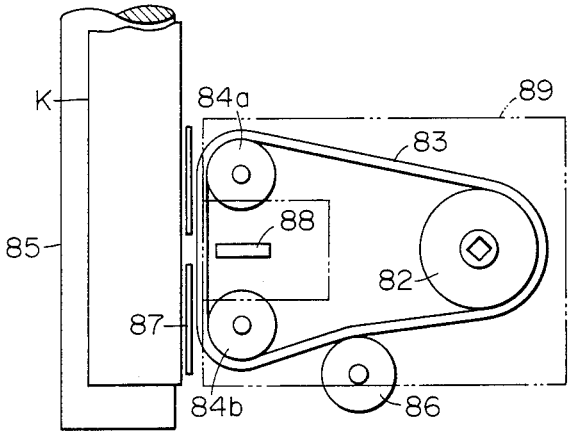
FIG. 24 is a top plan view of the type belt cassette.

As shown in FIG. 22, the type belt 83 has two type trains 83a, 83b in upper and lower rows on the type belt. The upper type train 83a confronts the platen 85 on the horizontal line passing through the axis of the platen 85 as shown in FIG. 22, while the lower type train 83b faces the platen 85 in a manner as shown in FIG. 23. For the latter purpose, the cassette 89 is so constructed that a supporting member 90 to fixedly mount the cassette thereon is fitted to a carriage (not shown) in a freely oscillatable manner with a shaft 91 as its center of oscillation, and the motor M is also mounted on the supporting member 90. An electromagnet 92 is mounted on the carriage, and a corresponding attraction piece 93 is fixed on the supporting member 90.

The printing hammer 88 is always placed at a constant position through a port 90a formed in the supporting member 90. The ink feeding roller 86 is held by a shaft 94, an arm 95, and a shaft 96, and is always press-contacted to the type belt 83 by means of a spring 97. A reference numeral 98 designates an opening formed in the cassette 89 for mounting and dismounting the ink feeding roller.

FIG. 22 shows use of the upper type train 83a of the type belt 83, wherein the supporting member 90 is positioned by a stopper 99. In case the lower type train 83b is used as shown in FIG. 23, the type belt 83 is rotated by the drive motor, and, at the same time, the solenoid 92 is energized to attract the piece 93 to it so as to tilt the supporting member 90, thereby shifting the selected type in the lower type train 83b to the hammer position 88, and performing the character printing with the printing hammer 88. Incidentally, there are two types for the printing: the one is a flying system, wherein the type is not stopped, and the other is a non-flying system, wherein the type is stopped. The present invention is applicable to either system.

Since the printer according to the present invention in the above-described embodiment arranges the type trains in both upper and lower rows on the belt, the area of the belt cassette can be descreased by merely increasing its height, which contributes to size-reduction of the printer. For the selection of the upper and lower type trains, the cassette supporting member is made freely tiltable and is controllable by the electromagnetic mechanism, hence its operation is extremely simple and easy. When the type trains are arranged in three rows, upper, middle, and lower, the middle type train is made the normal printing position, the lower type train is the same as in the FIG. 23, and the upper type train is made opposite to that in FIG. 23, i.e., the supporting member 90 is tilted downwardly. A signal for selecting the upper and lower type trains can be produced in such a manner that, for example, a signal button is provided close to the handle for laterally moving the carriage relative to the platen 85, and by its depression, electric current is caused to flow through the electromagnet 92 through the electric control circuit.

Figure 25:
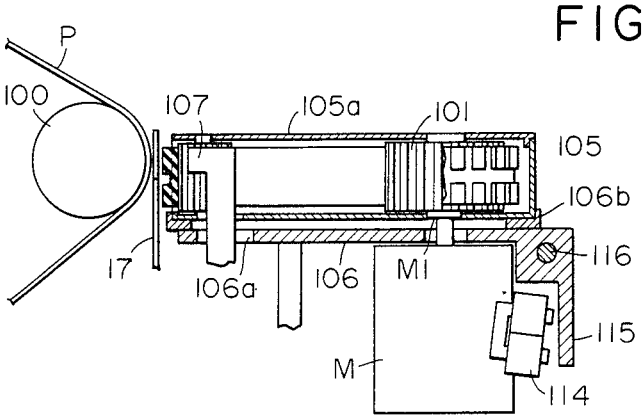
FIG. 25 is a side elevational view, in longitudinal cross-section, of another embodiment of the printer according to the present invention.
Figure 26:
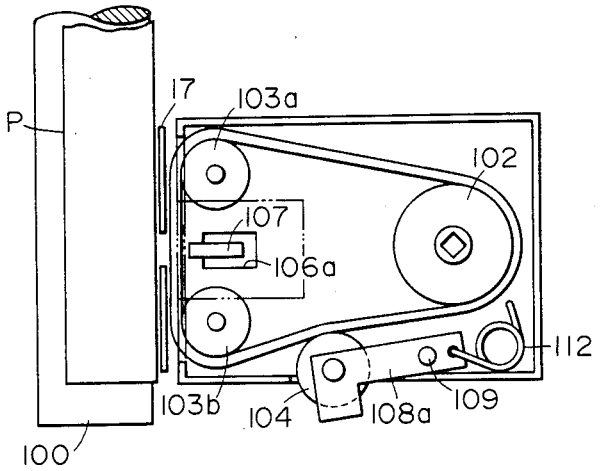
FIG. 26 is a top plan view of FIG. 25.
Figure 27:
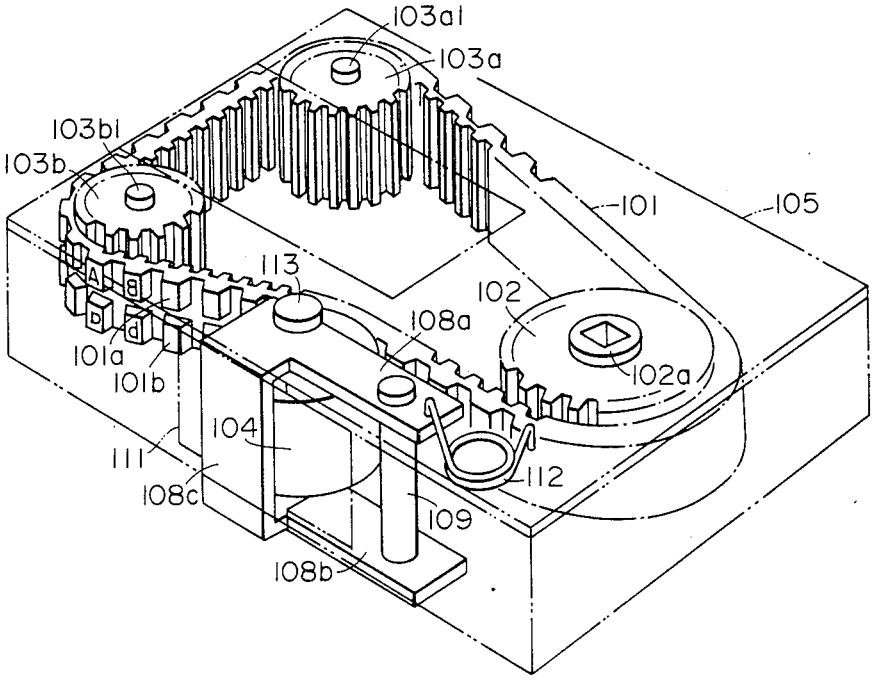
FIG. 27 is a perspective view of the character belt cassette in FIG. 25.

Referring now to FIGS. 25, 26 and 27, still another embodiment of the printer according to the present invention will be explained.

In the drawing, a numeral 100 refers to a platen, a letter P refers to a paper, a numeral 101 designates a type belt, a letter M designates a belt drive motor, a numeral 102 denotes a type belt drive pulley interlocked with the motor M, and reference numerals 103a, 103b designate type belt guide rollers. The rectilinear portion of the type belt between these two guide rollers is disposed in parallel with the platen 100, and a printing hammer is positioned at a substantially middle portion of the rectilinear section of the type belt. A reference numeral 104 designates an ink feeding roller to be press-contacted to the type belt 101.

As mentioned above, the present invention is characterized in that, in the impact type printer of such construction, the typ belt 101 and the ink feeding roller 104 are accommodated in the cassette 105, and the cassette 105 is made mountable and dismountable on and from the supporting plate 106. The supporting plate 106 is fitted to the carriage in the printer main body, which is movable in the lateral direction in parallel with the platen 100. The printing hammer 107 is also held by the carriage, which is inserted into the type belt cassette 105 passing through the opening 106a formed in the supporting plate 106, and is faced to the printing surface of the platen 100. Since the printer main body and the carriage are the same as those in the conventional printer, they are omitted from the illustration.

The cassette 105 is formed in a box-shape having three side wall surfaces. The side wall where the rectilinear portion of the type belt 101 is postioned is not provided. The top cover 105a of the cassette is detachably attached to the cassette. The bottom cover is fixedly provided. The pulley 102, the guide rollers 103a, 103b are rotatably held by the top and bottom covers. Reference numerals 108a, 108b designate respectively upper and lower bearing arms which are positioned on the outer surfaces of both top and bottom covers of the cassette 105 and fastened thereto with a shaft 109. 108c designates a connecting member to connect the upper and lower bearing arms at one portion of their free ends. 110 refers to a shaft for the ink feeding roller 104 supported by the upper and lower bearing arms 108a, 108b. 111 indicates an opening provided in one portion of the side wall surface of the cassette to permit the ink feeding roller 104 to be in and out of the cassette. 112 designates a coil spring which acts in the direction to constantly urge the ink feeding roller 104 to the type belt 101. The spring 112 is provided at any one of the bearing arms 108a, 108b, or between the shaft 109 and the cassette 105.

The cassette 105 is for example, slip-fitted in a positioning and cassette receiving member 106b on the supporting member 106. In this instance, the engaging member M1 on the motor shaft is engaged with a shaft 102a of the pulley 102. The cassette 105 is removed from the supporting member 106 followed by removal of the top cover 105a. The shafts 102a, $103a_1$ and $103b_1$ are made to simply fit in the top cover, whereby the top cover 105a may be readily removable. When the connecting member 108c for the bearing arms 108a, 108b, serving as the manipulating knob, is pulled against the spring 112, the type belt 101 is released from urging force of the ink feeding roller 104 with the consequence that the type belt can be easily removed from the pulley 102 and the rollers 103a, 103b for replacement, or partial change of the type can be done. The ink feeding roller 104 can be replaced by drawing out the shaft 113. Accordingly, users can operate the printer without staining their hands and clothing. Incidentally, the type belt 101 as illustrated in FIGS. 25, 26, and 27 has the upper and lower type trains 101*a*, 101*b*, and FIG. 26 shows a state of use of its upper type train.

When electric current is caused to pass through the electromagnet 114 fixedly mounted on the carriage to attract the piece 115 provided on the supporting member 106, the supporting member 106 tilts upwardly with the shaft 116 as the center of its oscillation, whereby the lower type train 101*b* is positioned at the printing surface of the platen 100.

What we claim is:

1. A printer, comprising:

carrying means mounted for movement along a recording medium;

rotatable type member mounted on said carrying means and including a plurality of types for recording data by impacting on the recording medium;

driving means mounted on said carrying means for rotating said type member;

detecting means mounted on said carrying means for detecting the angular position of said type member using light directed to said detecting means from a predetermined direction;

light generating means mounted off said carrying means, wherein light from said light generating means is directed along the direction of movement of said carrying means; and reflection means mounted on said carrying means for reflecting light from said light generating means to said detecting means along the predetermined direction.

2. A printer according to claim 1, wherein said detecting means includes a slit member and a light receiving member for detecting light passing through said slit member.

3. A printer according to claim 2, wherein said reflection means includes a reflection member for reflecting the light generated by said light generating means toward the predetermined direction.

4. A printer according to claim 3, wherein said type member includes a type wheel and said driving means includes a motor for rotating said type wheel, wherein said slit member integrally rotates with said type wheel.

5. A printer according to claim 4, wherein said detecting means further includes a second slit member.

6. A printer according to claim 5, wherein said second slit member includes an index slit.

7. A printer according to claim 5, wherein said second slit member is disposed between said first-mentioned slit member and said light receiving member.

8. A printer according to claim 1, wherein said light generating means includes a laser.

* * * * *

UNITED STATES PATENT AND TRADEMARK OFFICE

CERTIFICATE OF CORRECTION

PATENT NO. : 4,775,253

DATED : October 4, 1988

INVENTOR(S) : TOSHIAKI OZAWA, ET AL.

It is certified that error appears in the above-identified patent and that said Letters Patent is hereby corrected as shown below:

COLUMN 1

Line 57, "a group of of" should read --of a group of--.

COLUMN 2

Line 12, "chareacter" should read --character--.
Line 24, "diadvantage" should read --disadvantage--.
Line 28, "priner." should read --printer.--.
Line 45, "ara." should read --area.--.

COLUMN 3

Line 8, "an" should read --any--.
Line 15, "advantage" should read --disadvantage--.
Line 16, "operates" should read --operators--.
Line 28, "carrier," should read --carriage,--.
Line 36, "an" should read --any--.
Line 57, "is still" should read --is a still--.

COLUMN 5

Line 39, " polyurethance" should read --polyurethane--.
Line 40, "show" should read --shows--.
Line 44, "vlue" should read --value--.
Line 49, "than" should read --of--.

COLUMN 6

Line 68, "selets" should read --selects--.

UNITED STATES PATENT AND TRADEMARK OFFICE

CERTIFICATE OF CORRECTION

PATENT NO. : 4,775,253

DATED : October 4, 1988

INVENTOR(S) : TOSHIAKI OZAWA, ET AL.

It is certified that error appears in the above-identified patent and that said Letters Patent is hereby corrected as shown below:

COLUMN 7

Line 17, "print," should read --printing,--.
Line 19, "askewed" should read --a skewed--.
Line 23, "the type wheel as the whole" should read --the whole type wheel--.
Line 47, "are" should read --an--.
Line 61, "clutch disc 53" should read --clutch disk 47--.

COLUMN 8

Line 8, "member" should read --members--.
Line 35, "ber 47" should read --ber 59--.
Line 61, "65 a printing hammer." should read --68 a printing hammer.--.
Line 67, "are same" should read --are the same--.
Line 68, "in conventional" should read --in the conventional--.

COLUMN 9

Line 27, "platen 1" should read --platen 62--.
Line 32, "to" should be deleted.

COLUMN 10

Line 2, "gause d" should read --gauge d--.
Line 15, "print-" should read --printed--.
Line 16, "ing" should be deleted.

COLUMN 11

Line 46, "descreased" should read --decreased--.
Line 55, "the" (first occurrence) should be deleted.

UNITED STATES PATENT AND TRADEMARK OFFICE

CERTIFICATE OF CORRECTION

PATENT NO. : 4,775,253

DATED : October 4, 1988

INVENTOR(S) : TOSHIAKI OZAWA, ET AL.

It is certified that error appears in the above-identified patent and that said Letters Patent is hereby corrected as shown below:

COLUMN 12

Line 13, "typ" should read --type--.
Line 28, "postioned" should read --positioned--.
Line 49, "is" should read --is,--.

Signed and Sealed this

Twenty-eighth Day of March, 1989

*Attest:*

DONALD J. QUIGG

*Attesting Officer*

*Commissioner of Patents and Trademarks*